US009447642B2

(12) United States Patent
Bellin et al.

(10) Patent No.: US 9,447,642 B2
(45) Date of Patent: Sep. 20, 2016

(54) POLYCRYSTALLINE DIAMOND MATERIAL WITH HIGH TOUGHNESS AND HIGH WEAR RESISTANCE

(71) Applicant: Smith International, Inc., Houston, TX (US)

(72) Inventors: Federico Bellin, The Woodlands, TX (US); Yi Fang, Orem, UT (US); Michael Stewart, Provo, UT (US); Nephi A. Mourik, Provo, UT (US); Peter T. Cariveau, Draper, UT (US)

(73) Assignee: Smith International, Inc., Houston, TX (US)

( * ) Notice: Subject to any disclaimer, the term of this patent is extended or adjusted under 35 U.S.C. 154(b) by 200 days.

(21) Appl. No.: 14/076,431

(22) Filed: Nov. 11, 2013

(65) Prior Publication Data

US 2014/0060938 A1 Mar. 6, 2014

Related U.S. Application Data

(63) Continuation of application No. 12/851,677, filed on Aug. 6, 2010, now Pat. No. 8,579,053.

(60) Provisional application No. 61/232,134, filed on Aug. 7, 2009.

(51) Int. Cl.
*E21B 10/55* (2006.01)
*E21B 10/62* (2006.01)
(Continued)

(52) U.S. Cl.
CPC ..... *E21B 10/567* (2013.01); *C22C 26/00* (2013.01); *E21B 10/55* (2013.01); *E21B 10/5735* (2013.01); *B22F 2999/00* (2013.01); *C22C 2204/00* (2013.01)

(58) Field of Classification Search
CPC ..... E21B 10/55; E21B 2010/5654; E21B 10/567; E21B 10/573; E21B 10/62; B22F 2207/01; B22F 2207/13
See application file for complete search history.

(56) References Cited

U.S. PATENT DOCUMENTS 2,941,241 A 6/1960 Strong
2,941,248 A 6/1960 Hall
(Continued)

FOREIGN PATENT DOCUMENTS

EP 0235455 1/1992
EP 0219959 4/1992
(Continued)

OTHER PUBLICATIONS

International Search Report and Written Opinion of PCT Application No. PCT/US2010/044657 dated Mar. 17, 2011.
(Continued)

*Primary Examiner* — Cathleen Hutchins

(57) ABSTRACT

A cutting element that includes a substrate; and an outer layer of polycrystalline diamond material disposed upon the outermost end of the cutting element, wherein the polycrystalline diamond material: a plurality of interconnected diamond particles; and a plurality of interstitial regions disposed among the bonded diamond particles, wherein the plurality of interstitial regions contain a plurality of metal carbide phases and a plurality of metal binder phases together forming a plurality of metallic phases, wherein the plurality of metal carbide phases are formed from a plurality of metal carbide particles; wherein the plurality of interconnected diamond particles form at least about 60 to at most about 85% by weight of the polycrystalline diamond material; and wherein the plurality of metal carbide phases represent at least 35% by weight of the plurality of metallic phases is disclosed.

22 Claims, 3 Drawing Sheets

(51) Int. Cl.

| | |
|---|---|
| ***E21B 10/567*** | (2006.01) |
| ***C22C 26/00*** | (2006.01) |
| ***E21B 10/573*** | (2006.01) |

(56) References Cited

U.S. PATENT DOCUMENTS

| | | | | |
|---|---|---|---|---|
| 2,947,611 | A | 8/1960 | Bundy | |
| 3,609,818 | A | 10/1971 | Wentorf, Jr. | |
| 3,767,371 | A | 10/1973 | Wentorf, Jr. et al. | |
| 4,224,380 | A | 9/1980 | Bovenkerk et al. | |
| 4,289,503 | A | 9/1981 | Corrigan | |
| 4,311,490 | A | 1/1982 | Bovenkerk et al. | |
| 4,604,106 | A | 8/1986 | Hall et al. | |
| 4,667,756 | A | 5/1987 | King et al. | |
| 4,673,414 | A | 6/1987 | Lavens et al. | |
| 4,694,918 | A | 9/1987 | Hall | |
| 4,813,500 | A | 3/1989 | Jones | |
| 4,954,139 | A | 9/1990 | Cerutti | |
| RE33,757 | E | 12/1991 | Weaver | |
| 5,290,507 | A | 3/1994 | Runkle | |
| 5,370,195 | A | 12/1994 | Keshavan et al. | |
| 5,732,783 | A | 3/1998 | Truax et al. | |
| 6,009,962 | A | 1/2000 | Beaton | |
| 6,095,265 | A | 8/2000 | Alsup | |
| 6,193,000 | B1 | 2/2001 | Caraway et al. | |
| 6,199,645 | B1 | 3/2001 | Anderson et al. | |
| 6,241,036 | B1 | 6/2001 | Lovato et al. | |
| 6,290,008 | B1 * | 9/2001 | Portwood | E21B 10/5676 175/420.1 |
| 6,296,069 | B1 | 10/2001 | Lamine et al. | |
| 6,371,226 | B1 | 4/2002 | Caraway | |
| 6,375,706 | B2 | 4/2002 | Kembaiyan et al. | |
| 6,443,248 | B2 | 9/2002 | Yong et al. | |
| 6,458,471 | B2 | 10/2002 | Lovato et al. | |
| 6,461,401 | B1 | 10/2002 | Kembaiyan et al. | |
| 6,474,425 | B1 | 11/2002 | Truax et al. | |
| 6,510,906 | B1 | 1/2003 | Richert et al. | |
| 6,651,757 | B2 | 11/2003 | Belnap et al. | |
| 6,725,953 | B2 | 4/2004 | Truax et al. | |
| 6,742,611 | B1 | 6/2004 | Illerhaus et al. | |
| 6,843,333 | B2 | 1/2005 | Richert et al. | |
| 6,951,578 | B1 | 10/2005 | Belnap et al. | |
| 7,234,550 | B2 | 6/2007 | Azar et al. | |
| 7,350,599 | B2 | 4/2008 | Lockwood et al. | |
| 7,350,601 | B2 | 4/2008 | Belnap et al. | |
| 7,377,341 | B2 | 5/2008 | Middlemiss et al. | |
| 7,426,969 | B2 | 9/2008 | Azar | |
| 7,469,757 | B2 | 12/2008 | Azar et al. | |
| 7,497,280 | B2 | 3/2009 | Brackin et al. | |
| 7,533,740 | B2 | 5/2009 | Zhang et al. | |
| 7,757,793 | B2 | 7/2010 | Voronin et al. | |
| 2001/0000101 | A1 | 4/2001 | Lovato et al. | |
| 2001/0002557 | A1 | 6/2001 | Kembaiyan et al. | |
| 2001/0008190 | A1 | 7/2001 | Scott et al. | |
| 2001/0047891 | A1 | 12/2001 | Truax et al. | |
| 2002/0125048 | A1 | 9/2002 | Traux et al. | |
| 2003/0111273 | A1 | 6/2003 | Richert et al. | |
| 2004/0037948 | A1 | 2/2004 | Tank et al. | |
| 2004/0154840 | A1 | 8/2004 | Azar et al. | |
| 2004/0245022 | A1 | 12/2004 | Izaguirre et al. | |
| 2005/0133276 | A1 | 6/2005 | Azar | |
| 2005/0133278 | A1 | 6/2005 | Azar | |
| 2005/0230150 | A1 | 10/2005 | Oldham et al. | |
| 2006/0032677 | A1 | 2/2006 | Azar et al. | |
| 2006/0166615 | A1 | 7/2006 | Tank et al. | |
| 2006/0283637 | A1 | 12/2006 | Viel et al. | |
| 2007/0215389 | A1 | 9/2007 | Da Silva et al. | |
| 2007/0215390 | A1 | 9/2007 | Azar et al. | |
| 2007/0284153 | A1 | 12/2007 | Richert et al. | |
| 2008/0017421 | A1 | 1/2008 | Lockwood | |
| 2008/0073126 | A1 | 3/2008 | Shen et al. | |
| 2008/0128951 | A1 | 6/2008 | Lockwood et al. | |
| 2008/0135306 | A1 | 6/2008 | Da Silva et al. | |
| 2008/0142262 | A1 | 6/2008 | Drivdahl et al. | |
| 2008/0149398 | A1 | 6/2008 | Azar | |
| 2008/0185189 | A1 | 8/2008 | Griffo et al. | |
| 2008/0202821 | A1 | 8/2008 | McClain et al. | |
| 2008/0223623 | A1 | 9/2008 | Keshavan et al. | |
| 2008/0230280 | A1 | 9/2008 | Keshavan et al. | |
| 2008/0282618 | A1 | 11/2008 | Lockwood | |
| 2009/0090563 | A1 | 4/2009 | Voronin et al. | |
| 2009/0095532 | A1 | 4/2009 | Laird et al. | |
| 2009/0107732 | A1 | 4/2009 | McClain et al. | |
| 2009/0120008 | A1 | 5/2009 | Lockwood et al. | |
| 2009/0133938 | A1 | 5/2009 | Hall et al. | |
| 2009/0173547 | A1 | 7/2009 | Vorinin et al. | |
| 2009/0273224 | A1 | 11/2009 | Hall | |
| 2010/0062253 | A1 | 3/2010 | Egan et al. | |
| 2010/0196717 | A1 | 8/2010 | Liversage et al. | |
| 2010/0236836 | A1 | 9/2010 | Voronin | |
| 2011/0031032 | A1 | 2/2011 | Mourik et al. | |
| 2011/0031033 | A1 | 2/2011 | Mourik et al. | |
| 2011/0031037 | A1 | 2/2011 | Bellin et al. | |
| 2011/0036643 | A1 | 2/2011 | Belnap et al. | |
| 2011/0042147 | A1 | 2/2011 | Fang et al. | |
| 2014/0054095 | A1 | 2/2014 | Mourik et al. | |

FOREIGN PATENT DOCUMENTS

| | | |
|---|---|---|
| EP | 0487355 | 3/1995 |
| EP | 1006257 | 2/2004 |
| EP | 1330323 | 5/2006 |
| WO | 0234437 | 5/2002 |
| WO | 2008076908 | 6/2008 |
| WO | 2010020962 | 2/2010 |

OTHER PUBLICATIONS

International Search Report and Written Opinion of PCT Application No. PCT/US2010/044698 dated Mar. 21, 2011.

International Search Report and Written Opinion of PCT Application No. PCT/US2010/044640 dated Mar. 23, 2011.

International Search Report and Written Opinion of PCT Application No. PCT/US2010/044664 dated Mar. 30, 2011.

Anonymous, "PCD Hammer Bit Inserts," Guilin Color Engineered Diamond Technology (EDT) Co., Ltd., retrieved Jan. 6, 2010, www.guilinedt.com, www.heavendiamonds.com.

Third Party Reference Submission of Australian Application No. 2010279358 dated Apr. 24, 2013: pp. 1-13.

Third Party Reference Submission of Australian Application No. 2010279280 dated Apr. 24, 2013: pp. 1-9.

Third Party Reference Submission of Australian Application No. 2010279295 dated Apr. 24, 2013: pp. 1-12.

* cited by examiner

POLYCRYSTALLINE DIAMOND MATERIAL WITH HIGH TOUGHNESS AND HIGH WEAR RESISTANCE

CROSS-REFERENCE TO RELATED APPLICATIONS

This application is a continuation application of U.S. patent application Ser. No. 12/851,677, filed on Aug. 6, 2010, which claims priority to U.S. Provisional Patent Application No. 61/232,134, filed on Aug. 7, 2009, the contents of which are herein incorporated by reference in their entirety.

BACKGROUND

1. Field

Embodiments disclosed herein relate generally to polycrystalline diamond enhanced inserts for use in drill bits, such as roller cone bits and hammer bits, in particular. More specifically, the disclosure relates to polycrystalline diamond enhanced inserts having an outer layer that includes diamond, metal carbide, and cobalt.

2. Background Art

In a typical drilling operation, a drill bit is rotated while being advanced into a soil or rock formation. The formation is cut by cutting elements on the drill bit, and the cuttings are flushed from the borehole by the circulation of drilling fluid that is pumped down through the drill string and flows back toward the top of the borehole in the annulus between the drill string and the borehole wall. The drilling fluid is delivered to the drill bit through a passage in the drill stem and is ejected outwardly through nozzles in the cutting face of the drill bit. The ejected drilling fluid is directed outwardly through the nozzles at high speed to aid in cutting, flush the cuttings and cool the cutter elements.

There are several types of drill bits, including roller cone bits, hammer bits, and drag bits. Roller cone rock bits include a bit body adapted to be coupled to a rotatable drill string and include at least one "cone" that is rotatably mounted to a cantilevered shaft or journal as frequently referred to in the art. Each roller cone in turn supports a plurality of cutting elements that cut and/or crush the wall or floor of the borehole and thus advance the bit. The cutting elements, either inserts or milled teeth, contact with the formation during drilling. Hammer bits are typically include a one piece body with having crown. The crown includes inserts pressed therein for being cyclically "hammered" and rotated against the earth formation being drilled.

Depending on the type and location of the inserts on the bit, the inserts perform different cutting functions, and as a result also, also experience different loading conditions during use. Two kinds of wear-resistant inserts have been developed for use as inserts on roller cone and hammer bits: tungsten carbide inserts and polycrystalline diamond enhanced inserts. Tungsten carbide inserts are formed of cemented tungsten carbide: tungsten carbide particles dispersed in a cobalt binder matrix. A polycrystalline diamond enhanced insert typically includes a cemented tungsten carbide body as a substrate and a layer of polycrystalline diamond ("PCD") directly bonded to the tungsten carbide substrate on the top portion of the insert. An outer layer formed of a PCD material can provide improved wear resistance, as compared to the softer, tougher tungsten carbide inserts.

Depending on the type and location of the inserts on the bit, the inserts perform different cutting functions, and as a result also, also experience different loading conditions during use. Two kinds of wear-resistant inserts have been developed for use as inserts on roller cone and hammer bits: tungsten carbide inserts and polycrystalline diamond enhanced inserts. Tungsten carbide inserts are formed of cemented tungsten carbide: tungsten carbide particles dispersed in a cobalt binder matrix. A polycrystalline diamond enhanced insert typically includes a cemented tungsten carbide body as a substrate and a layer of polycrystalline diamond ("PCD") directly bonded to the tungsten carbide substrate on the top portion of the insert. An outer layer formed of a PCD material can provide improved wear resistance, as compared to the softer, tougher tungsten carbide inserts.

The layer(s) of PCD conventionally include diamond and a metal in an amount of up to about 20 percent by weight of the layer to facilitate diamond intercrystalline bonding and bonding of the layers to each other and to the underlying substrate. Metals employed in PCD are often selected from cobalt, iron, or nickel and/or mixtures or alloys thereof and can include metals such as manganese, tantalum, chromium and/or mixtures or alloys thereof. However, while higher metal catalyst content typically increases the toughness of the resulting PCD material, higher metal content also decreases the PCD material hardness, thus limiting the flexibility of being able to provide PCD coatings having desired levels of both hardness and toughness. Additionally, when variables are selected to increase the hardness of the PCD material, typically brittleness also increases, thereby reducing the toughness of the PCD material.

Although the polycrystalline diamond layer is extremely hard and wear resistant, a polycrystalline diamond enhanced insert may still fail during normal operation. Failure typically takes one of three common forms, namely wear, fatigue, and impact cracking. The wear mechanism occurs due to the relative sliding of the PCD relative to the earth formation, and its prominence as a failure mode is related to the abrasiveness of the formation, as well as other factors such as formation hardness or strength, and the amount of relative sliding involved during contact with the formation. Excessively high contact stresses and high temperatures, along with a very hostile downhole environment, also tend to cause severe wear to the diamond layer. The fatigue mechanism involves the progressive propagation of a surface crack, initiated on the PCD layer, into the material below the PCD layer until the crack length is sufficient for spalling or chipping. Lastly, the impact mechanism involves the sudden propagation of a surface crack or internal flaw initiated on the PCD layer, into the material below the PCD layer until the crack length is sufficient for spalling, chipping, or catastrophic failure of the enhanced insert.

During manufacture of the cutting elements, the materials are typically subjected to sintering under high pressure/high temperature ("HPHT") conditions, which can lead to potential problems involving dissimilar elements being bonded to each other and the diffusion of various components, resulting in residual stresses induced on the composites. The residual stress induced composites can often result in insert breakage, fracture, or delamination under drilling conditions.

External loads due to contact tend to cause failures such as fracture, spalling, and chipping of the diamond layer. Internal stresses, for example thermal residual stresses resulting from the manufacturing process, tend to cause delamination between the diamond layer and the substrate or the transition layer, either by cracks initiating along the interface and propagating outward, or by cracks initiating in the diamond layer surface and propagating catastrophically along the interface.

The impact, wear, and fatigue life of the diamond layer may be increased by increasing the diamond thickness and thus diamond volume. However, the increase in diamond volume result in an increase in the magnitude of residual stresses formed on the diamond/substrate interface that foster delamination. This increase in the magnitude in residual stresses is believed to be caused by the difference in the thermal contractions of the diamond and the carbide substrate during cool-down after the sintering process. During cool-down after the diamond bodies to the substrate, the diamond contracts a smaller amount than the carbide substrate, resulting in residual stresses on the diamond/substrate interface. The residual stresses are proportional to the volume of diamond in relation to the volume of the substrate.

It is, therefore, desirable that an insert structure be constructed that provides desired PCD properties of hardness and wear resistance with improved properties of fracture toughness and chipping resistance, as compared to conventional PCD materials and insert structures, for use in aggressive cutting and/or drilling applications.

SUMMARY

In one aspect, embodiments disclosed herein relate to a cutting element that includes a substrate; and an outer layer of polycrystalline diamond material disposed upon the outermost end of the cutting element, wherein the polycrystalline diamond material: a plurality of interconnected diamond particles; and a plurality of interstitial regions disposed among the bonded diamond particles, wherein the plurality of interstitial regions contain a plurality of metal carbide phases and a plurality of metal binder phases together forming a plurality of metallic phases, wherein the plurality of metal carbide phases are formed front a plurality of metal carbide particles; wherein the plurality of interconnected diamond particles form at least about 60 to at most about 85% by weight of the polycrystalline diamond material; and wherein the plurality of metal carbide phases represent at least 35% by weight of the plurality of metallic phases.

In another aspect, embodiments disclosed herein relate to a cutting element that includes a substrate; and an outer layer of polycrystalline diamond material disposed upon the outermost end of the cutting element, wherein the polycrystalline diamond material: a plurality of interconnected diamond particles; and a plurality of interstitial regions disposed among the bonded diamond particles, wherein the plurality of interstitial regions contain a plurality of metal carbide phases and a plurality of metal binder phases together forming a plurality of metallic phases, wherein the plurality of metal carbide phases are formed from a plurality of metal carbide particles; wherein the plurality of interconnected diamond particles form at least about 60 to at most about 85% by weight of the polycrystalline diamond material; and wherein the plurality of metal carbide phases represent about 7 to 35% by weight of the polycrystalline diamond material.

In yet another aspect, embodiments disclosed herein relate to a cutting element that includes a substrate; and an outer layer of polycrystalline diamond material disposed upon the outermost end of the cutting element, wherein the polycrystalline diamond material: a plurality of interconnected diamond particles; and a plurality of interstitial regions disposed among the bonded diamond particles, wherein the plurality of interstitial regions contain a plurality of metal carbide phases and a plurality of metal binder phases together forming a plurality of metallic phases, wherein the plurality of metal carbide phases are formed from a plurality of metal carbide particles; wherein the plurality of interconnected diamond particles form at least about 60 to at most about 85% by weight of the polycrystalline diamond material; and wherein the plurality of metal carbide phases represent at least 35% by weight of the plurality of metallic phases.

Other aspects and advantages of the disclosure will be apparent from the following description and the appended claims.

DETAILED DESCRIPTION

In one aspect, embodiments disclosed herein relate to polycrystalline diamond enhanced inserts for use in drill bits, such as roller cone bits and hammer bits, or other cutting tools. More specifically, embodiments disclosed herein relate to cutting elements having an outer layer that includes a predetermined amount of polycrystalline diamond and an optimum ratio of metal carbide to cobalt, for use in drill bits or other cutting tools. In particular, embodiments of the present disclosure relate to cutting elements having reduced thermal residual stress as well as both increased toughness and wear resistance, thus providing for improved and prolonged life of the cutting elements. In particular embodiments, such outer layer may be used on a cutting element that possesses at least one transition layer.

Figure 1:
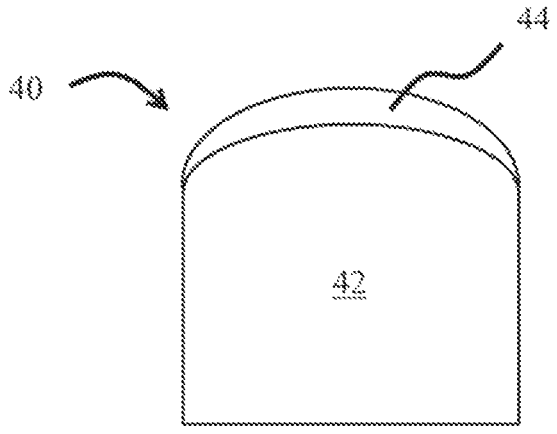
FIG. 1 shows an illustration of one embodiment of a cutting element in accordance with the present disclosure.

Referring to FIG. 1, a cutting element in accordance with one embodiment of the present disclosure is shown. As shown in FIG. 1, a cutting element 40 includes a polycrystalline diamond outer layer 44 that forms the working or exposed surface for contacting the earth formation or other substrate to be cut. Under the polycrystalline diamond outer layer 44, is substrate 42. While a no transition layers are shown in FIG. 1, some embodiments may only include one, two, three, even more transition layers, as discussed below.

The polycrystalline diamond outer layer discussed above may include a body of diamond particle where one or more metallic phases may be present in each interstitial region disposed between the diamond particles. In particular, as used herein, "polycrystalline diamond" or "a polycrystalline diamond material" refers to this three-dimensional network or lattice of bonded together diamond grains. Specifically, the diamond to diamond bonding is catalyzed by a metal (such as cobalt) by a high temperature/high pressure process, whereby the metal remains in the regions between the particles. The metal binder particles added to the diamond particles may function as a catalyst and/or binder, depending on the exposure to diamond particles that can be catalyzed as well as the temperature/pressure conditions. For the purposes of this application, when the metal binder is referred to as a metal binder, it does not necessarily mean that no catalyzing function is also being performed, and when the metal is referred to as a metal catalyst, it does not necessarily mean that no binding function is also being performed.

However, the metal binder present in the interstitial regions is not the only metallic phase that may be present. Rather, a metallic phase, as used herein, refers to any metal containing phase present in the interstitial regions. Thus, reference to a metallic phase may refer to either a metal binder phase or a metal carbide phase, and the plurality of metallic phases present in the plurality of interstitial regions is defined to include both a plurality of metal binder phases and a plurality metal carbide (or carbonitride) phases amongst all of the interstitial regions. However, each interstitial region may individually contain a metal binder phase and/or a metal carbide phase. Thus, the metal binder phase and the metal carbide phase together form the metallic phase. Further, the metal binder phase and the metal carbide phase are formed from metal binder particles and metal carbide (or carbonitride) particles, respectively.

In accordance with embodiments of the present disclosure, the metallic phases may be designed to have at least 50% by weight of the metallic phases be formed from metal carbide. Use of such high levels of carbide in the metallic phases present in the interstitial regions may result in a polycrystalline diamond material that possesses both high hardness (and wear/abrasion resistance) as well as high fracture toughness. Specifically, a cutting element that includes an outer layer in accordance with embodiments of the present disclosure may have a hardness value in excess of 3000 Hv in one embodiment, and in excess of 3500 Hv in another embodiment. Further, a cutting element that includes an outer layer in accordance with embodiments of the present disclosure may also have an improved toughness. Cyclic fatigue life data is a good indicator of fracture toughness. For example, cutting elements that includes an outer layer in accordance with embodiments of the present disclosure may be compared to a reference or comparative cutting element (specifically, comparative cutting element 1 shown in Table below, having a composition of 80 wt % diamond, 19 wt % Co, and 1 wt % WC), and the fatigue life of the cutting elements of the present disclosure may have an increased fatigue life of over 100% of the comparative cutting, element fatigue. Other embodiments may possess a fatigue life improvement of over 30% or over 50% as compared to the comparative cutting element. Thus, embodiments of the present disclosure may exceed the benchmark in toughness, fatigue and wear resistance as compared to the comparative cutting element.

Depending on the relative abrasion resistance/toughness desired for the polycrystalline diamond outer layer, a quantity of diamond particles and/or metal binder particles may be replaced with metal carbide particles added with the metal binder to create a polycrystalline diamond outer layer possessing both hardness and toughness.

The diamond content in the polycrystalline diamond layer may depend, for example, on the particular properties desired, but may broadly be at least 60 percent by weight of the polycrystalline diamond material, and ranging up to 80 or 85 percent by weight of the polycrystalline diamond material in various particular embodiments. For example, when a slightly tougher diamond body is desired, the diamond content may range from 60 to 68 percent by weight of the polycrystalline diamond material. Conversely, when a slightly harder diamond body is desired, the diamond content may be at least 70 percent by weight (and at least 80 percent by weight in more particular embodiments) with an upper limit of about 85 percent by weight. However, in yet other particular embodiments, the diamond content may fall in the range of 68 to 75 percent by weight.

Depending on the diamond content, the total content of the metallic phases (metal binder and metal carbide) will obviously vary; however, in accordance with embodiments of the present disclosure, the ratio between the two types of metallic phase may selected to be at least 50% by weight metal carbide and no more than 50% by weight metal binder. In particular embodiments, the metal carbide portion may represent at least 55% by weight of the metallic phase and at least 60% by weight of the metallic phase in more particular embodiments. However, One skilled in the art should appreciate after learning the teachings of the present disclosure contained this application that this amount must be less than 100%, as there may be a minimum amount of cobalt necessary to catalyze the formation of the diamond-to-diamond bonds in the polycrystalline diamond material. In some embodiments, the metal binder may represent at least 25 percent by weight of the metallic phases, but may be as low as 12 percent by weight in other embodiments. The particular minimum amount of metal binder (in relation to the metal carbide) may depend on the total diamond content, with lower diamond content having a lesser lower limit than a polycrystalline diamond material with a greater diamond content.

As discussed above, a metal carbide (or carbonitride) phase may contribute to at least 50 percent by weight of the metallic phases in at the interstitial regions. The metal carbide phases may be formed from particles of carbides of elements selected from the group consisting of tungsten (W), titanium (Ti), tantalum (Ta), chromium (Cr), molybdenum (Mo), niobium (Nb), vanadium (V), hafnium (Hf), and zirconium (Zr). With respect to the entire polycrystalline diamond material (and not just the metallic phases), the metal carbide may be present in layer in an amount that is ranges from about 7 to 35 weight percent percent of the total polycrystalline diamond material. In a particular embodiment, the metal carbide particles may have an average particle size less than 2 μm. However, the powder may agglomerate and join together during sintering to fill the space. Thus in a uniform microstructure, the size of carbide phase could be almost as large as the grain size of the diamond or in the range 5-30 micron in size. However, carbide size may ultimately be selected based on desired properties of the layer(s) as well as the other layer components. For example, in one embodiment, it may be desirable for the average size of the metal carbide phases formed from such carbide particles be less than the average size of the diamond particles to which they are bonded. Additionally, the average size of the interstitial regions, i.e., the distance between the bonded diamond particles, is also preferably less than the average size of the diamond particles. Thus, the carbide particle size may also be selected based on the particular diamond particle size being used.

As discussed above, the outer layer also includes a metal binder in the interstitial regions. Such metals may include Group VIII metals, including Co, Fe, Ni, and combinations thereof. With respect to the entire polycrystalline diamond material (and not just the metallic phases), the metal binder may be present in layer in an amount that ranges from 5 to 20 weight percent of the total polycrystalline diamond material. One skilled in the art should appreciate after learning the teachings of the present disclosure contained this application the amount of binder used in the outer layer may be based on the carbide amount selected for the metallic phase as well as the diamond content.

The average diamond grain size used to form the polycrystalline diamond outer layer may broadly range from about 2 to 30 microns in one embodiment, less than about 20 microns in another embodiment, and less than about 15 microns in yet another embodiment. However, in various other particular embodiments, the average grain size may range from about 2 to 8 microns, from about 4 to 8 microns, from about 10 to 12 microns, or from about 10 to 20 microns. It is also contemplated that other particular narrow ranges may be selected within the broad range, depending on the particular application and desired properties of the outer layer. Further, it is also within the present disclosure that the particles need not be unimodal, but may instead be bi- or otherwise multi-modal.

In certain embodiments, the thickness of the outer layer may be about 0.006 inches. In other more preferred embodiments, the outer layer thickness may be about 0.016 inches or greater. As used herein, the thickness of any polycrystalline diamond layer refers to the maximum thickness of that layer, as the diamond layer may vary in thickness across the layer. Specifically, as shown in U.S. Pat. No. 6,199,645, which is herein incorporated by reference in its entirety, it is within the scope of the present disclosure that the thickness of a polycrystalline diamond layer may vary so that the thickness is greatest within the critical zone of the cutting element. It is expressly within the scope of the present disclosure that a polycrystalline diamond layer may vary or taper such that it has a non-uniform thickness across the layer. Such variance in thickness may generally result from the use of non-uniform upper surfaces of the insert body/substrate in creating a non-uniform interface.

The insert body or substrate may be formed from a suitable material such as tungsten carbide, tantalum carbide, or titanium carbide. In the substrate, metal carbide grains are supported by a matrix of a metal binder. Thus, various binding metals may be present in the substrate, such as cobalt, nickel, iron, alloys thereof, or mixtures, thereof. In a particular embodiment, the insert body or substrate may be formed of a sintered tungsten carbide composite structure of tungsten carbide and cobalt. However, it is known that various metal carbide compositions and binders may be used in addition to tungsten carbide and cobalt. Thus, references to the use of tungsten carbide and cobalt are for illustrative purposes only, and no limitation on the type of carbide or binder use is intended.

As discussed above, the cutting elements of the present disclosure may have at least one transition layer. The at least one transition layer may include composites of diamond grains, a metal binder, and metal carbide or carbonitride particles. One skilled in the art should appreciate after learning the teachings of the present disclosure contained this application that the relative amounts of diamond and metal carbide or carbonitride particles may indicate the extent of diamond-to-diamond bonding within the layer.

The presence of at least one transition layer between the polycrystalline diamond outer layer and the insert body/substrate may create a gradient with respect to thermal expansion coefficients and elasticity, minimizing a sharp change in thermal expansion coefficient and elasticity between the layers that would otherwise contribute to cracking and chipping of the PCD layer from the insert body/substrate. Such a gradient may include a gradient in the diamond content between the outer layer and the transition layer(s), decreasing from the outer layer moving towards the insert body, coupled with a metal carbide content that increases from the outer layer moving towards the insert body.

Thus, the at least one transition layer may include composites of diamond grains, a metal binder, and carbide or carbonitride particles, such as carbide or carbonitride particles of tungsten, tantalum, titanium, chromium, molybdenum, vanadium, niobium, hafnium, zirconium, or mixtures thereof, which may include angular or spherical particles. When using tungsten carbide, it is within the scope of the present disclosure that such particles may include cemented tungsten carbide (WC/Co), stoichiometric tungsten carbide (WC), cast tungsten carbide ($WC/W_2C$), or a plasma sprayed alloy of tungsten carbide and cobalt (WC—Co). In a particular embodiment, either cemented tungsten carbide or stoichiometric tungsten carbide may be used, with size ranges of up to 6 microns for stoichiometric tungsten carbide or in the range of 5 to 30 microns (or up to the diamond grain size for the layer) for cemented particles. It is well known that various metal carbide or carbonitride compositions and binders may be used in addition to tungsten carbide and cobalt. Thus, references to the use of tungsten carbide and cobalt in the transition layers are for illustrative purposes only, and no limitation on the type of metal carbide/carbonitride or binder used in the transition layer is intended. Further, the same or similar carbide or carbonitride particle types may be present in the outer layer, when desired, as discussed above.

The carbide (or carbonitride) amount present in the at least one transition may vary between about 25 and 90 weight percent (or between 10 and 80 volume percent) of the at least one transition layer. As discussed above, the use of transition layer(s) may allow for a gradient in the diamond and carbide content between the outer layer and the transition layer(s), the diamond decreasing from the outer layer moving towards the insert body, coupled with the metal carbide content increasing from the outer layer moving towards the insert body. However, no limitation exists on the particular ranges. Rather, any range may be used in forming the carbide gradient between the layers. Further, if the carbide content is increasing between the outer layer and one or more transition layers, the diamond content may correspondingly decrease between the outer layer and the one or more transition layers.

Cutting elements formed in accordance with embodiments of the present disclosure may result in significantly less internal thermal residual stress due to the presence of an optimum ratio of metal carbide to cobalt throughout the cutting element. Specifically, the residual stress which is typically present in the substrate, transition layer(s), outer layer, and the interfaces therebetween, is substantially decreased due to the presence of metal carbide phases, cobalt phases, and combinations thereof, being uniformly distributed among the bonded diamond particles and at least partially filling in the gaps between the bonded diamond particles.

Moreover, by controlling the ratio of metal carbide to cobalt and increasing the overall diamond content it is possible to tailor the grade wear abrasion and fracture toughness properties of the cutting element, thus improving the life of the cutting element and drill bit. Specifically, by disposing on a substrate an outer layer that includes an increased volume of diamond particles, an optimized ratio of metal carbide to cobalt, and a predetermined maximum volume of cobalt, it is possible to optimize both the toughness and wear resistance of a cutting element and thus improve the overall life of the cutting element.

As used herein, a polycrystalline diamond layer refers to a structure that includes diamond particles held together by intergranular diamond bonds, formed by placing an unsintered mass of diamond crystalline particles within a metal enclosure of a reaction cell of a HPHT apparatus and subjecting individual diamond crystals to sufficiently high pressure and high temperatures (sintering under HPHT conditions) that intercrystalline bonding occurs between adjacent diamond crystals. A metal catalyst, such as cobalt or other Group VIII metals, may be included with the unsintered mass of crystalline particles to promote intercrystalline diamond-to-diamond bonding. The catalyst material may be provided in the form of powder and mixed with the diamond grains, or may be infiltrated into the diamond grains during HPHT sintering.

The reaction cell is then placed under processing conditions sufficient to cause the intercrystalline bonding between the diamond particles. It should be noted that if too much additional non-diamond material, such as tungsten carbide or cobalt is present in the powdered mass of crystalline particles, appreciable intercrystalline bonding is prevented during the sintering process. Such a sintered material where appreciable intercrystalline bonding has not occurred is not within the definition of PCD.

The transition layers may similarly be formed by placing an unsintered mass of the composite material containing: diamond particles, tungsten carbide and cobalt within the HPHT apparatus. The reaction cell is then placed under processing conditions sufficient to cause sintering of the material to create the transition layer. Additionally, a preformed metal carbide substrate may be included. In which case, the processing conditions can join the sintered crystalline particles to the metal carbide substrate. Similarly, a substrate having one or more transition layers attached thereto may be used in the process to add another transition layer or a polycrystalline diamond layer. A suitable HPHT apparatus for this process is described in U.S. Pat. Nos. 2,947,611; 2,941,241; 2,941,248; 3,609,818; 3,767,371; 4,289,503; 4,673,414; and 4,954,139.

An exemplary minimum temperature is about 1200° C., and an exemplary minimum pressure is about 35 kilobars. Typical processing is at a pressure of about 45-55 kilobars and a temperature of about 1300-1500° C. The minimum sufficient temperature and pressure in a given embodiment may depend on other parameters such as the presence of a catalytic material, such as cobalt. Typically, the diamond crystals will be subjected to the HPHT sintering the presence of a diamond catalyst material, such as cobalt, to form an integral, tough, high strength mass or lattice. The catalyst, e.g., cobalt, may be used to promote recrystallization of the diamond particles and formation of the lattice structure, and thus, cobalt particles are typically found within the interstitial spaces in the diamond lattice structure. Those of ordinary skill will appreciate that a variety of temperatures and pressures may be used, and the scope of the present disclosure is not limited to specifically referenced temperatures and pressures.

Application of the processing will cause diamond crystals to sinter and form a polycrystalline diamond layer. Similarly, application of HPHT to the composite material will cause the diamond crystals and carbide particles to sinter such that they are no longer in the form of discrete particles that can be separated from each other. Further, all of the layers bond to each other and to the substrate during the HPHT process.

It is also within the scope of the present disclosure that the polycrystalline diamond outer layer may have at least a portion of the metal catalyst removed therefrom, such as by leaching the diamond layer with a leaching agent (often a strong acid). In a particular embodiment, at least a portion of the diamond layer may be leached in order to gain thermal stability without losing impact resistance.

Additionally, the present application refers it its constituent parts as being represented in weight percents, which is indicative of a sintered part. One method to determine the weight percents of a particular cutting element is to take a polished sample cut of the cutting element and perform a weight atomic mass scan of the area and extrapolate the weight percent for the entire volume of the cutting element. Additionally, the pre-sintered powder weight percentages may also be indicative of the sintered part.

Exemplary Embodiments

The following examples are provided in table form to aid in demonstrating the variations that may exist in the outer layer in accordance with the teachings of the present disclosure. Additionally, while each example is indicated to an outer layer composition, it is also within the present disclosure that more or less transition layers may be included between the outer layer and the carbide insert body (substrate). These examples are not intended to be limiting, but rather one skilled in the art should appreciate that further compositional variations may exist within the scope of the present disclosure.

| Example | % wt | | | Relative amount | |
|---|---|---|---|---|---|
| No. | Diamond | Co | WC | Co | WC |
| 1 | 80 | 9 | 11 | 46 | 54 |
| 2 | 77 | 8 | 15 | 36 | 64 |
| 3 | 72 | 8 | 20 | 27 | 73 |
| 4 | 70 | 12 | 18 | 40 | 60 |
| 5 | 68 | 12 | 21 | 36 | 64 |
| 6 | 64 | 15 | 21 | 41 | 59 |
| 7 | 60 | 14 | 26 | 36 | 64 |
| Comp. 1 | 80 | 19 | 1 | 95 | 5 |

According to one embodiment of the present disclosure, a drill bit, such as a roller cone bit, hammer bit, or drag bit, includes at least one cutting element having a substrate and an outer layer having a three-dimensional microstructure as described above. In another embodiment of the disclosure, a drill bit may also include at least one other type of cutting element, e.g., a cutting element not in accordance with embodiments of the present disclosure.

Figure 2:
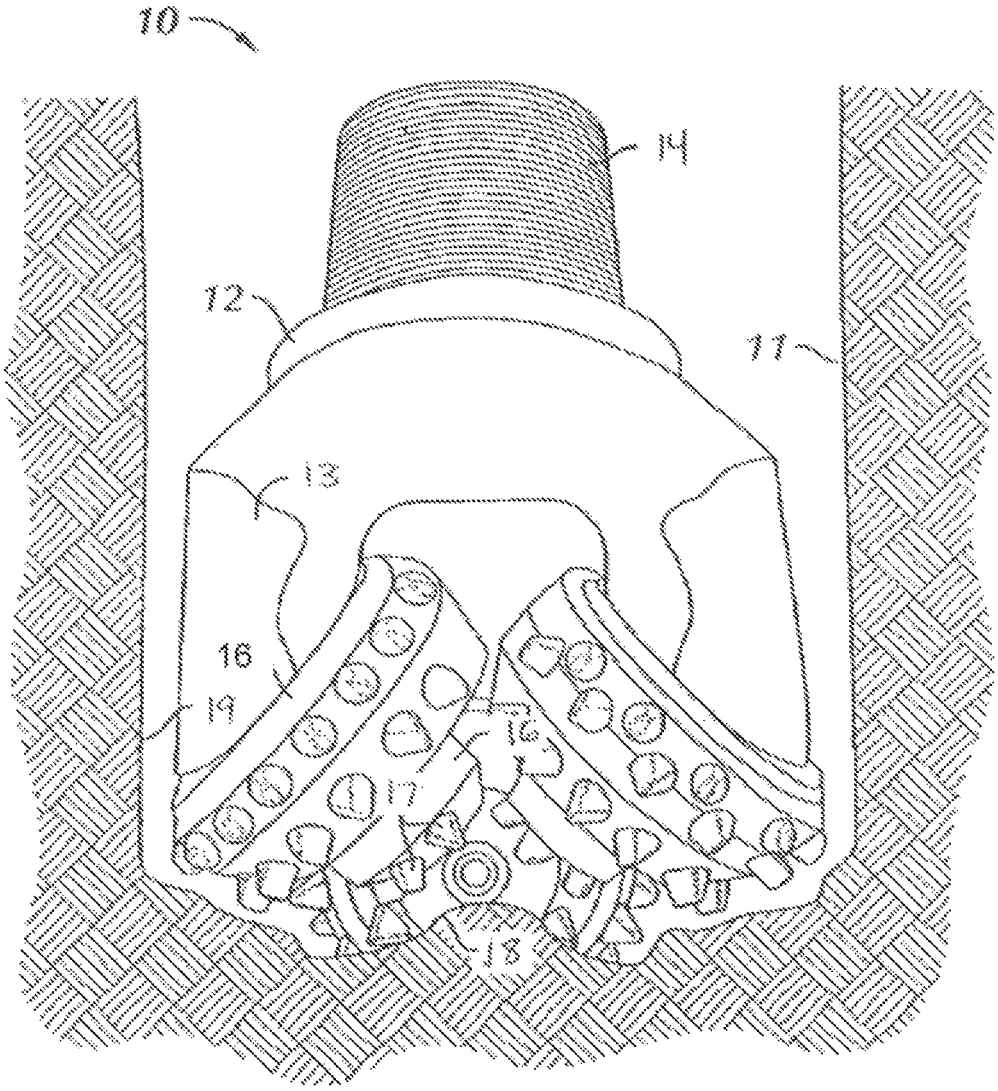
FIG. 2 is a side view of a roller cone rock bit.

The cutting elements of the present disclosure may find particular use in roller cone hits and hammer bits. Roller cone rock bits include a bit body adapted to be coupled to a rotatable drill string and include at least one "cone" that is rotatably mounted to the bit body. Referring to FIG. 2, a roller cone rock bit 10 is shown disposed in a borehole 11. The bit 10 has a body 12 with legs 13 extending generally downward, and a threaded pin end 14 opposite thereto for attachment to a drill string (not shown). Journal shafts (not shown) are cantilevered from legs 13. Roller cones (or rolling cutters) 16 are rotatably mounted on journal shafts. Each roller cone 16 has a plurality of cutting elements 17 mourned thereon. As the body 10 is rotated by rotation of the drill string (not shown), the roller cones 16 rotate over the borehole bottom 18 and maintain the gage of the borehole by rotating against a portion of the borehole sidewall 19. As the roller cone 16 rotates, individual cutting elements 17 are rotated into contact with the formation and then out of contact with the formation.

Figure 3:
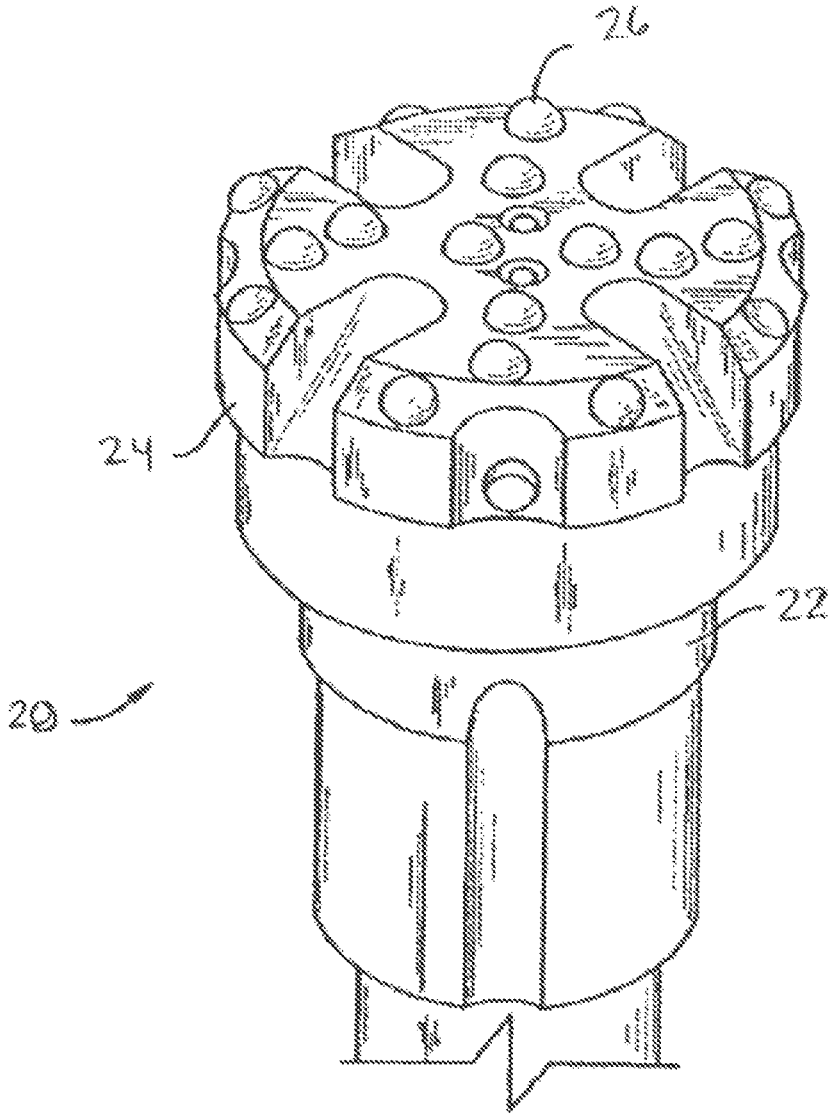
FIG. 3 is a side view of a hammer bit.

Hammer hits typically are impacted by a percussion hammer while being rotated against the earth formation being drilled. Referring to FIG. 3, a hammer bit is shown. The hammer bit 20 has a body 22 with a head 24 at one end thereof. The body 22 is received in a hammer (not shown), and the hammer moves the head 24 against the formation to fracture the formation. Cutting elements 26 are mounted in the head 24. Typically the cutting elements 26 are embedded in the drill bit by press fitting or brazing into the bit.

Figure 4:
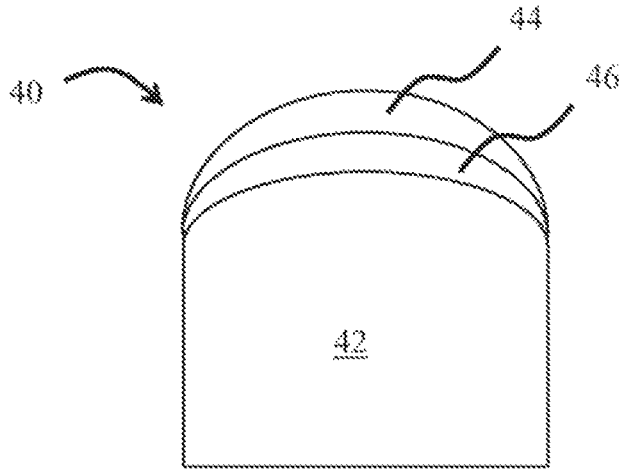
FIG. 4 shows an illustration of one embodiment of a cutting element in accordance with the present disclosure.

Referring to FIGS. 1 and 4, a novel cutting element in accordance with embodiments of the present disclosure is shown. In one embodiment, as shown in FIG. 1, a cutting element 40 includes a substrate 42 and an outer layer 44 for contacting the earth formation. In another embodiment, as shown in FIG. 4, a cutting element 40 includes a substrate 42, an outer layer 44, and at least one transition layer 46 disposed between the outer layer 44 and the substrate 42. While only one transition layer is shown in FIG. 1, some embodiments may include more than one transition layer. In some embodiments of the present disclosure, the at least one transition layer may comprise, for example, diamond particles, metal carbide, and cobalt.

As shown in FIGS. 1 and 4, substrate 42 has a cylindrical grip portion from which a convex protrusion extends. Outer layer 44 (and optional transition layers) are disposed on the convex protrusion forming a convex working end. The grip may be embedded in and affixed to holes on a roller cone or hammer bit. The protrusion may be, for example, hemispherical (commonly referred to as semi-round top) or may be conical, chisel-shaped, or other shapes known in the art of cutting elements. In some embodiments, the diamond outer layer (and any optional transition layers) may extend beyond the convex protrusion and may coat the cylindrical grip. Additionally, it is also within the scope of the present disclosure that the cutting elements described herein may have a planar upper surface, such as would be used in a drag bit.

Control over the metal carbide to cobalt volumetric ratio as well as over diamond and cobalt content, therefore, provides a way to control both the toughness and wear resistance of a particular cutting element. Cutting elements in accordance with embodiments of this disclosure can be used in a number of different applications, such as tools for mining and construction applications, where mechanical properties of high fracture toughness, wear resistance, and hardness are highly desired. Additionally, cutting elements in accordance with embodiments of this disclosure can be used to form wear and cutting components in such downhole cutting tools as roller cone bits, percussion or hammer bits, and drag bits, and a number of different cutting and machine tools.

The present disclosure, therefore, provides a tough, wear resistant cutting element for use in rock bits. As a result, bits having cutting elements made in accordance with embodiments of the present disclosure will last longer, meaning fewer trips to change the bit, reducing the amount of rig down time, which results in a significant cost saving. In general, these advantages are realized through selecting appropriate diamond content as well as the optimized metal carbide to cobalt ratio.

Advantages of the embodiments of the present disclosure may include one or more of the following. A cutting element having a substrate and an outer layer as described herein would allow for a cutting element with reduced thermal residual stress. In addition to thermal advantages, cutting elements of the present disclosure having an increased volume of diamond particles may also provide for an increase in fracture toughness. Additionally, the presence of an optimum ratio of metal carbide to cobalt in the outer layer of the cutting element prevents the decrease in wear resistance that usually results from such an increase in fracture toughness. Furthermore, by providing such an optimum ratio of metal carbide to cobalt, the microstructure of the outer layer has an average elastic modulus and equivalent thermal expansion coefficient that is much closer to the substrate compared to cutting elements known in the art. This implies that the thermal residual stresses arising during the HP/HT sintering process are lower, allowing for the outer layer to have both increased toughness and wear resistance, thus improving and prolonging the life of the cutting element.

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed:

1. A cutting element, comprising:

a substrate; and an outer layer of polycrystalline diamond material disposed upon the outermost end of the cutting element, wherein the polycrystalline diamond material comprises:

a plurality of interconnected diamond particles; and a plurality of interstitial regions disposed among the bonded diamond particles, wherein the plurality of interstitial regions contain a plurality of metal carbide phases and a plurality of metal binder phases together forming a plurality of metallic phases, wherein the plurality of metal carbide phases are formed from a plurality of metal carbide particles;

wherein the plurality of interconnected diamond particles form at least about 60 to at most about 85% by weight of the polycrystalline diamond material; and wherein the plurality of metal carbide phases represent at least 35% by weight of the plurality of metallic phases.

2. The cutting element of claim 1, wherein the plurality of interconnected diamond particles form at least about 60 to at most about 68% by weight of the polycrystalline diamond material.

3. The cutting element of claim 1, wherein the plurality of interconnected diamond particles form at least about 68 to at most about 72% by weight of the polycrystalline diamond material.

4. The cutting element of claim 1, wherein the plurality of metal binder phases represent at least 12% by weight of the plurality of metallic phases.

5. The cutting element of claim 4, wherein the plurality of metal binder phases represent at least 25% by weight of the plurality of metallic phases.

6. The cutting element of claim 1, wherein the average size of the diamond particles is greater than the average size of the metal carbide phases.

7. The cutting element of claim 1, wherein the polycrystalline diamond material has a hardness of at least 3000 HV.

8. The cutting element of claim 1, wherein the polycrystalline diamond material has a hardness of at least 3500 HV.

9. The cutting element of claim 1, wherein an average distance between the bonded diamond particles is less than an average particle size of the diamond particles.

10. The cutting element of claim 1, further comprising at least one transition layer disposed between the substrate and the outer layer, wherein the at least one transition layer comprises diamond particles, metal carbide, and a metal binder.

11. The cutting element of claim 10, wherein the at least one transition layer has a diamond content less than a diamond content of the outer layer.

12. The cutting element of claim 10, wherein the at least one transition layer has a metal carbide content greater than a metal carbide content of the outer layer.

13. A cutting element, comprising:

a substrate; and an outer layer of polycrystalline diamond material disposed upon the outermost end of the cutting element, wherein the polycrystalline diamond material comprising:

a plurality of interconnected diamond particles; and a plurality of interstitial regions disposed among the bonded diamond particles, wherein the plurality of interstitial regions contain a plurality of metal carbide phases and a plurality of metal binder phases together forming a plurality of metallic phases, wherein the plurality of metal carbide phases are formed from a plurality of metal carbide particles;

wherein the plurality of interconnected diamond particles form at least about 60% by weight of the polycrystalline diamond material; and wherein the plurality of metal carbide phases represent about 7 to 35% by weight of the polycrystalline diamond material, and wherein the plurality of metal carbide phases represent at least 35% by weight of the plurality of metallic phases.

14. The cutting element of claim 13, wherein the plurality of metal carbide phases represent at least 50% by weight of the plurality of metallic phases.

15. The cutting element of claim 13, wherein the plurality of metal binder phases represent at least 12% by weight of the plurality of metallic phases.

16. The cutting element of claim 15, wherein the plurality of metal binder phases represent at least 25% by weight of the plurality of metallic phases.

17. The cutting element of claim 13, wherein the plurality of interconnected diamond particles form at least about 75% by weight of the polycrystalline diamond material.

18. The cutting element of claim 13, wherein the plurality of interconnected diamond particles form no more than about 85% by weight of the polycrystalline diamond material.

19. The cutting element of claim 13, further comprising at least one transition layer disposed between the substrate and the outer layer, wherein the at least one transition layer comprises diamond particles, metal carbide, and a metal binder.

20. The cutting element of claim 19, wherein the at least one transition layer has a diamond content less than a diamond content of the outer layer.

21. The cutting element of claim 19, wherein the at least one transition layer has a metal carbide content greater than a metal carbide content of the outer layer.

22. A drill bit, comprising:

a tool body, and at least one cutting element, the cutting element comprising:

a substrate; and an outer layer of polycrystalline diamond material disposed upon the outermost end of the cutting element, wherein the polycrystalline diamond material comprising:

a plurality of interconnected diamond particles; and a plurality of interstitial regions disposed among the bonded diamond particles, wherein the plurality of interstitial regions contain a plurality of metal carbide phases and a plurality of metal binder phases together forming a plurality of metallic phases, wherein the plurality of metal carbide phases are formed from a plurality of metal carbide particles;

wherein the plurality of interconnected diamond particles form at least about 60% by weight of the polycrystalline diamond material; and wherein the plurality of metal carbide phases represent at least 35% by weight of the plurality of metallic phases.

* * * * *